US005816277A

United States Patent [19]

Jansen

[11] Patent Number: 5,816,277

[45] Date of Patent: Oct. 6, 1998

[54] WHITE STICK FOR BLIND PERSONS

[75] Inventor: Reindert Jan Jansen, Baarn, Netherlands

[73] Assignee: Techn-O-Tape, BV, Netherlands

[21] Appl. No.: 875,065

[22] PCT Filed: Oct. 22, 1996

[86] PCT No.: PCT/NL96/00411

§ 371 Date: Sep. 22, 1997

§ 102(e) Date: Sep. 22, 1997

[87] PCT Pub. No.: WO97/15265

PCT Pub. Date: May 1, 1997

[30] Foreign Application Priority Data

Oct. 25, 1995 [NL] Netherlands ..... 1001500

[51] Int. Cl.[6] ..... A45B 7/00

[52] U.S. Cl. ..... 135/65; 135/911; 135/66

[58] Field of Search ..... 135/65, 66, 911, 135/910

[56] References Cited

U.S. PATENT DOCUMENTS

| | | | |
|---|---|---|---|
| 3,546,467 | 12/1970 | Benjamin, Jr. et al. | 135/65 X |
| 4,280,204 | 7/1981 | Elchinger | 135/911 X |
| 4,648,710 | 3/1987 | Ban et al. | 135/911 X |
| 4,858,125 | 8/1989 | Washizuka et al. | 135/65 X |
| 5,097,856 | 3/1992 | Chi-Sheng | 135/911 X |
| 5,303,954 | 4/1994 | Suda | 135/66 X |

FOREIGN PATENT DOCUMENTS

| | | | |
|---|---|---|---|
| 6190011 | 7/1994 | Japan | 135/65 |
| 9301911 | 11/1993 | Netherlands . | |
| 2238386 | 5/1991 | United Kingdom . | |

*Primary Examiner*—Lanna Mai

*Attorney, Agent, or Firm*—St.Onge Steward Johnston & Reens LLC

[57] ABSTRACT

The invention relates to a white stick with a transmitter for emitting directed signals, a receiver for receiving signals which are reflected by an object and with display means for converting received signals into an indication which is perceptible by the user of the white stick. The display means includes an at least partially ring-shaped element extending around the white stick and which through a motor is rotatable around an axis which substantially coincides with the centerline of the white stick, wherein the plane in which said ring-shaped element is positioned encloses an angle with said axis differing from 90°. It is possible that the ring-shaped element is at least partially housed in a recess provided in the surface in the white stick.

6 Claims, 1 Drawing Sheet

WHITE STICK FOR BLIND PERSONS

The invention relates to a whitestick with a transmitter for emitting directed signals, a receiver for receiving signals which are reflected by an object and with display means for converting received signals into an indication which is perceptible by the user of the whitestick.

As is well known a whitestick is an essential auxiliary means for blind or partially sighted persons during orienting. However, a disadvantage of the known whitestick is that its reach is limited. For solving this problem attempts have been made in the past to offer an increased "reach" to a partially sighted or blind person. Thus the whitestick was provided with a transmitter and a receiver, whereby received signals were converted into a perceptible indication. Among others, examples of such known whitesticks can be found in Austrian patent specification 355.099 describing a whitestick which is provided with vibration means positioned in the handle, and in German Gebrauchsmuster 9300256, from which a whitestick is known comprising a plate which can be put into vibration.

Also Dutch patent application 93.01911 any United States and foreign patent as may issue therefrom being incorporated herein by reference thereto, in the name of applicant relates to a whitestick of the type referred to above, in which the perceptible indication is realised by means of a notch projecting to a more or less extent.

These known whitesticks have several drawbacks. The constructions and control means which are required for obtaining the desired result are often complicated and thus expensive. Further the whitesticks require a lot of (electrical) energy, thus that their operation time is very limited.

It is an object of the present invention to provide a whitestick of the present type which does not show these disadvantages.

Thus the whitestick according to the invention is characterised in that the display means comprise an at least partially ring-shaped element extending around the whitestick and which through a motor is rotatable around an axis which substantially coincides with the centerline of the whitestick, wherein the plane in which said ring-shaped element is positioned encloses an angle with said axis differing from 90°.

Because the ring-shaped element is positioned in a plane enclosing an angle with the axis of rotation differing from 90°, a rotation of the ring-shaped element around said axis of rotation creates a change of the distance between the ring-shaped element and a defined fixed point at the circumference of the whitestick, such as for example a hand of the user at that position. Thus, during a rotation of the ring-shaped element, the user as it were feels a movement of said ring-shaped element into forward or backward direction, like this obtaining the desired perceptible indication of the distance towards an object registrated by means of the transmitter and receiver.

The construction of the whitestick according to the invention is extremely simple. Further already a small rotation of the ring-shaped element leads to a clearly perceptible variation of the position of said element. Such a small rotation only needs little energy, such that the whitestick has a long period of operation when using batteries.

With respect to the construction of the ring-shaped element a number of possibilities exist. A simple embodiment is characterised by the fact, that the ring-shaped element is anchor-shaped. In this embodiment both legs of the anchor together define a ring segment which follows the circumference of the whitestick. The neck of the anchor defines the connection between said ring segment and the axis of rotation.

However it is possible too that the ring-shaped element is a complete ring fully encircling the whitestick. Of course said ring is connected with the axis of rotation by means of a connecting part. The advantage of this embodiment is, that a damaging of the ring shaped element and the entrance of pollutions into the whitestick is almost completely excluded.

Further it is advantageous, that the ring-shaped element is at least partially housed in a recess provided in the surface of the whitestick. Like this the ring-shaped element is largely protected against external influences, whereas nevertheless the user can clearly feel the movement of the ring-shaped element. Further it is a result of such a partially protected positioning of said ring-shaped element that the counter force exerted onto the ring-shaped element by the user is minimised, such that the energy consumption of the whitestick is further decreased.

Further a special embodiment should be mentioned, according to which the ring-shaped element is mounted directly onto the outgoing shaft of the motor. Like this the energy consumption can be limited to an absolutely minimised value. For, to obtain a displacement of the ring-shaped element the rotation of the motor is limited to a fraction of a complete revolution.

Finally control-wise it is preferred that with the motor-shaft there is also connected a magnet which cooperates with a Hall-sensor for indicating and controlling the angle of rotation of the motor.

Hereinafter the invention will be elucidated referring to the drawing in which a number of embodiments of the whitestick according to the invention are illustrated.

Figure 1:
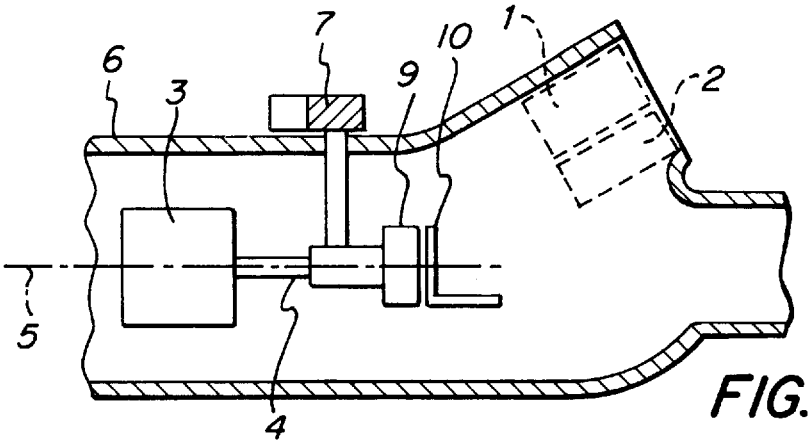
FIG. 1 shows schematically and in cross section a part of a first embodiment of the whitestick according to the invention.
Figure 3:
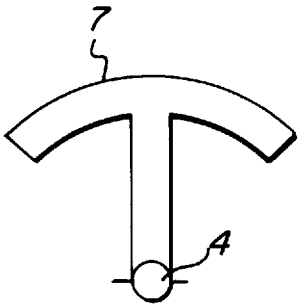
FIG. 3 shows the ring-shaped element applied in the whitestick according to FIG. 1.
Figure 4:
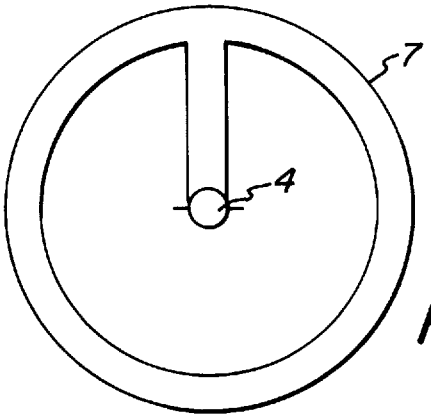
FIG. 4 shows an alternative ring-shaped element.

FIG. 1 shows in cross section and schematically part of a whitestick according to the invention. Housed therein is a transmitter 1 for emitting directed signals and a receiver 2 for receiving signals which are reflected by an object. Through lines not shown the transmitter 1 and receiver 2 are connected with a processing unit not shown either which, depending upon the signals received, controls a motor 3. The outgoing shaft 4 of the motor 3 coincides with the centerline 5 of the whitestick 6. A partially ring-shaped element 7 is mounted onto the outgoing shaft 4. This ring-shaped element 7 may be shaped in different ways, for example in correspondence with FIG. 3 as an anchor or in correspondence with FIG. 4 as a complete ring.

Figure 2:
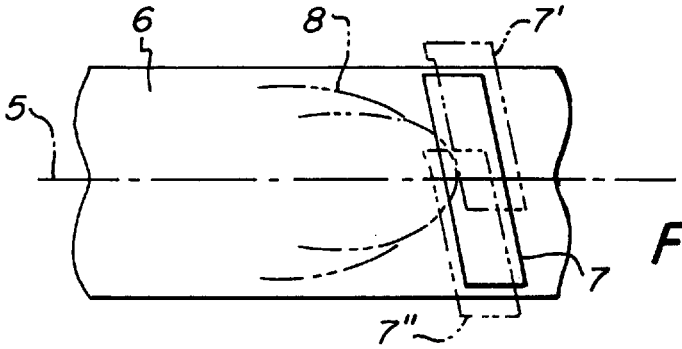
FIG. 2 shows a top plan view of the whitestick illustrated in FIG. 1.

As appears clearly from FIG. 2 the ring-shaped element 7 extends in a plane which encloses an angle with the outgoing shaft 4 or centerline 5, respectively, differing from 90°. Thus a rotation of the ring-shaped element 7 around shaft 4 will lead to an apparent displacement of the ring-shaped element 7 in longitudinal direction of the whitestick 6 relative to a fixed position thereof or, as indicated, relative to a finger 8 of the user positioned thereon. Thus, starting from the starting position 7 of the ring-shaped element represented in FIG. 2 a rotation towards position 7' will lead to an increase of the distance between the ring-shaped element and the finger 8, whereas otherwise a rotation towards position 71" leads to a decrease of said distance. This changing distance provides for an indication which is perceptible by the user and which is a measure of the distance to a registrated object as determined by the transmitter 1, the receiver 2 and not-illustrated processing unit.

In the shown embodiment the ring-shaped element 7 is directly mounted onto the outgoing shaft 4 of the motor 3, such that the motor 3 only needs to rotate over a small angle. As a result the energy consumption is extremely low.

In order to be able to indicate or control, respectively, the angle of rotation of the motor 3, further in correspondence with the shown embodiment a magnet 9 is attached to the outgoing shaft 4, which magnet cooperates without contact with a Hall-sensor 10 indicated only schematically. Of course also potentiometers can be used for this goal, but this leads to an increase of friction in the system and thus to an increase of energy consumption.

Figure 5:
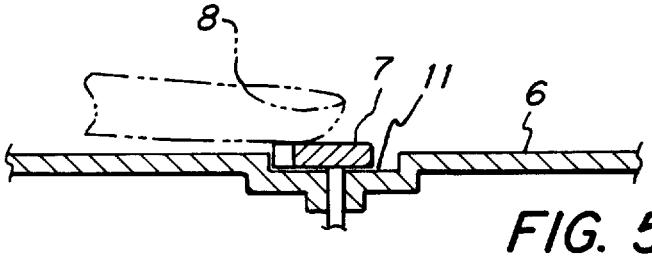
FIG. 5 shows a detail of a further embodiment of the whitestick according to the invention.

Finally FIG. 5 shows a special embodiment of the whitestick according to the invention, at which in the surface of the whitestick 6 a recess 11 is shaped which at least partially houses the ring-shaped element 7. Like this the ring-shaped element 7 is protected against damage, whereas further the entrance of pollution is limited to a minimum. Further this embodiment has the disadvantage that the force exerted onto the ring-shaped element 7 by a finger 8 or the like is small, such that the energy consumption of the whitestick for rotating the ring-shaped element 7 is minimised. Nevertheless the motion of the ring-shaped element 7, especially the increase or decrease, respectively, of its distance towards the finger of the user is readily perceptible by the user. Possibly an appropriate profile may be provided on the ring-shaped element 7 in this context.

The invention is not limited to the embodiment described before which can be varied widely within the scope of the invention as defined by the claims.

I claim:

1. A whitestick for a person having impaired eyesight and having, a transmitter for emitting directed signals, a receiver for receiving signals which are reflected by an object and with display means for converting received signals into an indication of direction of the object so as to make the object perceptible by the user of the whitestick, characterized in that the display means comprises a motor having an output shaft whose rotation is controlled by said receiving signals and an at least partially ring-shaped element extending around the whitestick and which is coupled to the motor shaft which is located in the whitestick so as to be rotatable around an axis which is generally aligned with the centerline of the whitestick, wherein the plane in which said ring-shaped element is positioned forms an angle with said axis which is different from 90° so that a rotation of said element about said axis provides the user of the whitestick with an axial offset indicative of the direction of the object.

2. A whitestick according to claim 1, characterized in that the ring-shaped element is anchor-shaped.

3. A whitestick according to claim 1, characterized in that the ring-shaped element is a complete ring fully encircling the whitestick.

4. A whitestick according to claim 1, characterized in that the whitestick has a recess in a surface of the whitestick and wherein said ring-shaped element is at least partially housed in said recess.

5. A whitestick according to claim 1, characterized in that the ring-shaped element is directly mounted onto the shaft of the motor.

6. A whitestick according to claim 5, and further comprising a magnet coupled to the motor shaft and a Hall-Effect sensor located in cooperative relationship with the magnet.

* * * * *